US006540431B1

(12) United States Patent
Okabe et al.

(10) Patent No.: US 6,540,431 B1
(45) **Date of Patent: *Apr. 1, 2003**

(54) CONNECTOR SUPPORT STRUCTURE

(75) Inventors: Toshiaki Okabe, Shizuoka-ken (JP); Kenji Oishi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 51 days.

This patent is subject to a terminal disclaimer.

(21) Appl. No.: 09/721,965

(22) Filed: Nov. 27, 2000

(30) Foreign Application Priority Data

Dec. 10, 1999 (JP) ..... 11-352307

(51) Int. Cl.[7] ..... H01R 13/20; H01R 13/62

(52) U.S. Cl. ..... 403/356; 403/355; 403/322.4; 439/157

(58) Field of Search ..... 439/157; 403/356, 403/350, 355, 322.1

(56) References Cited

U.S. PATENT DOCUMENTS 5,484,297 A * 1/1996 Takahashi et al. ..... 439/157
5,628,642 A * 5/1997 Bieringer et al. ..... 439/157
5,658,162 A * 8/1997 Harting et al. ..... 439/372
5,954,528 A * 9/1999 Ono et al. ..... 439/157
6,036,510 A * 3/2000 Ono et al. ..... 439/157
6,120,308 A * 9/2000 Hayashi ..... 439/157
6,332,789 B1 * 12/2001 Okabe ..... 439/157
6,343,944 B1 * 2/2002 Okabe ..... 439/157

FOREIGN PATENT DOCUMENTS

JP 10-021992 1/1998

* cited by examiner

*Primary Examiner*—Lynne H. Browne
*Assistant Examiner*—Ernesto Garcia
(74) *Attorney, Agent, or Firm*—Finnegan, Henderson, Farabow, Garrett, & Dunner, L.L.P.

(57) ABSTRACT

A connector support structure including first and second connectors is disclosed. The first connector is supported by a part to be assembled. The second connector is to be fitted with the first connector. The first connector includes a first connector body and a plurality of rotary members. The first connector body has projections. The rotary members include rear engagement projections and cut-out parts for provisionally fastening engagement with the projections of the first connector body. The part to be assembled includes an engagement panel including cut-out parts for receiving the rear engagement projections while the projections of the first connector body are in provisionally fastening engagement with the cut-out parts of the rotary members.

5 Claims, 10 Drawing Sheets

CONNECTOR SUPPORT STRUCTURE

BACKGROUND OF THE INVENTION

1. Field of the Invention

The present invention relates to a connector support structure.

2. Description of Relevant Art

Conventionally, this kind of a connector support structure of a technology according to Japanese Patent Application Laid-Open Publication No. 10-21992 has been known.

The connector support structure is generally composed of a holder to be mounted to a hole defined by a part to be assembled such as a stay member of an automobile, a first connector slidably fitted in the holder, a second connector joined to a side of electronic unit, and a rotary lever supported by a supporting axis on the first connector, the lever to drive the second connector in a direction for connection with the first connector.

SUMMARY OF THE INVENTION

However, in the conventional connector, the first connector is provisionally fastened against the holder at an initial insertion-position, and it is necessary to form a provisionally-fastening part to the first connector. With this, it is also necessary to form a projection for provisionally fastening to the holder.

In addition, due to preventing the first connector inserted in such the initial insertion-position from dropping off out of the holder, a projection for prevention from dropping off is formed to the first connector, and it is necessary to form a drop-prevention part to the holder. Thus, the conventional structure has a drawback that structure is complicated because the respective members are formed with a provisionally fastening structure and a drop-prevention structure.

The provisionally fastening part formed to the first connector and the drop-prevention part formed to the holder are set to be resiliently deformed when inserting the first connector to the holder. In these parts, because of, for example, operation of arrangement of a wire harness connected to the first connector and load caused by assembly operation of the holder and the first connector at an inappropriate position, the parts are possible to be bent and damaged.

The connector support structure has necessity that the engagement pin is fitted when inserting the first connector in the holder assembled to the part to be mounted. With the first connector being inserted in the holder, the lever can rotate freely, and an operation to make the engagement pin inserted in the guide groove needs a skill. Thus, there is a drawback that an assembly operation is complicated.

An object of the invention is to provide a connector support structure that makes assembly performed reliably and easily.

To achieve the object, a first aspect of the present invention provides a connector support structure. The structure includes a first connector having a rear end side supported by a part to be assembled and a second connector to be fitted the first connector to be mounted from a front end side thereof. The first connector and the second connector is electrically joined each other. The first connector includes a first connector body, and rotary members supported to the first connector body by supporting axe for free end parts of the rotary members to project from a rear end face of the first connector body. The rotary members include rear engagement projections provided at the free end parts. The rear engagement projections project in substantially a right angle relative to rotation faces of the rotary members. The rotary members include front engagement projections provided at positions in the free end parts closer to the supporting axe than to the rear engagement projections. The rotary members include cut-out parts for provisionally fastening for engagement with projections for provisionally fastening provided on the first connector body. The part to be assembled includes an engagement panel defining cut-out parts for projection passage to pass the rear engagement projections from a front side to a back side when engaging the projections for provisionally-fastening with the cut-out parts of the rotary members for the rotary members to be provisionally fastened to make rotations of the rotation members impossible.

Preferably, the part to be assembled defines a slit part to allow the rotary members to be slid, with the rear engagement projections passing on the back side of the panel through the cut-out parts of the panel.

Preferably the part to be assembled includes a pair of engagement panels spaced each other at a distance. The pair of engagement panels are arranged to oppose to side edges thereof each other on substantially an identical plane. The panel defines the cut-out parts for projection passage at the side edges thereof.

Preferably, the cut-out parts for provisionally fastening are to be disengaged with the projections for provisionally fastening in accordance with rotations of the rotary members.

Preferably, the projections for provisionally fastening are to be engaged with periphery parts of the rotary members to restrict the rotary members in directions of disengagement thereof when the rear engagement projections and the front engagement projections hold the engagement panel therebetween for the first connector to be mounted to the part to be assembled.

Preferably, the rotary members have projections for rotation to engage with the second connector for transmitting rotation force to the rotary members when fitting the second connector with the first connector.

According to the invention, with the projections for provisionally-fastening formed to the first connector body being engaged with the cut-out parts for provisionally-fastening formed to the rotary members, the rotary members is provisionally fastened to the first connector body to make rotations impossible. When the rotary members are provisionally fastened to the first connector body, the rear engagement projections provided to the free end parts of the rotary members are possible to pass from the front side to the back side through the cut-out parts for projection passage of the engagement panel of the part to be assembled.

As a result, with the rotary members being not provisionally fastened, the rear engagement projections can not be positioned at a back face side of the engagement panel, and the first connector can not be mounted to the part to be assembled. Thus, the first connector is assembled to the part reliably and smoothly.

The first connector is slid to the part to be assembled to keep out of the part to be assembled, thus being able to be moved at an appropriate position where the rear engagement projections is well abuttingly engaged to the engagement panel.

With a simple structure with a pair of the engagement panels, the first connector is reliably engaged and mounted to the part to be assembled. As described above, a structure of a part to be assembled is simple, and production of the part to be assembled becomes easier.

Engagement and disengagement with the projections for provisionally-fastening and the cut-out parts for provisionally-fastening are possible, and when mounting the second connector to the first connector after the first connector is mounted to the part to be assembled, they can be disengaged. Thus, rotation drive force for the rotary member is easily drawn out, the force being generated such that the second connector pushes the rotary member.

The projections for provisionally fastening formed to the first connector body each have a function to provisionally fasten the rotary members and a function to prevent the rotary members from reverse rotation.

The projections for rotation are provided to the rotary members, and the rotary members can be rotated by a low load.

BRIEF DESCRIPTION OF THE ACCOMPANYING DRAWINGS

DETAILED DESCRIPTION OF THE PREFERRED EMBODIMENTS

Figure 1:
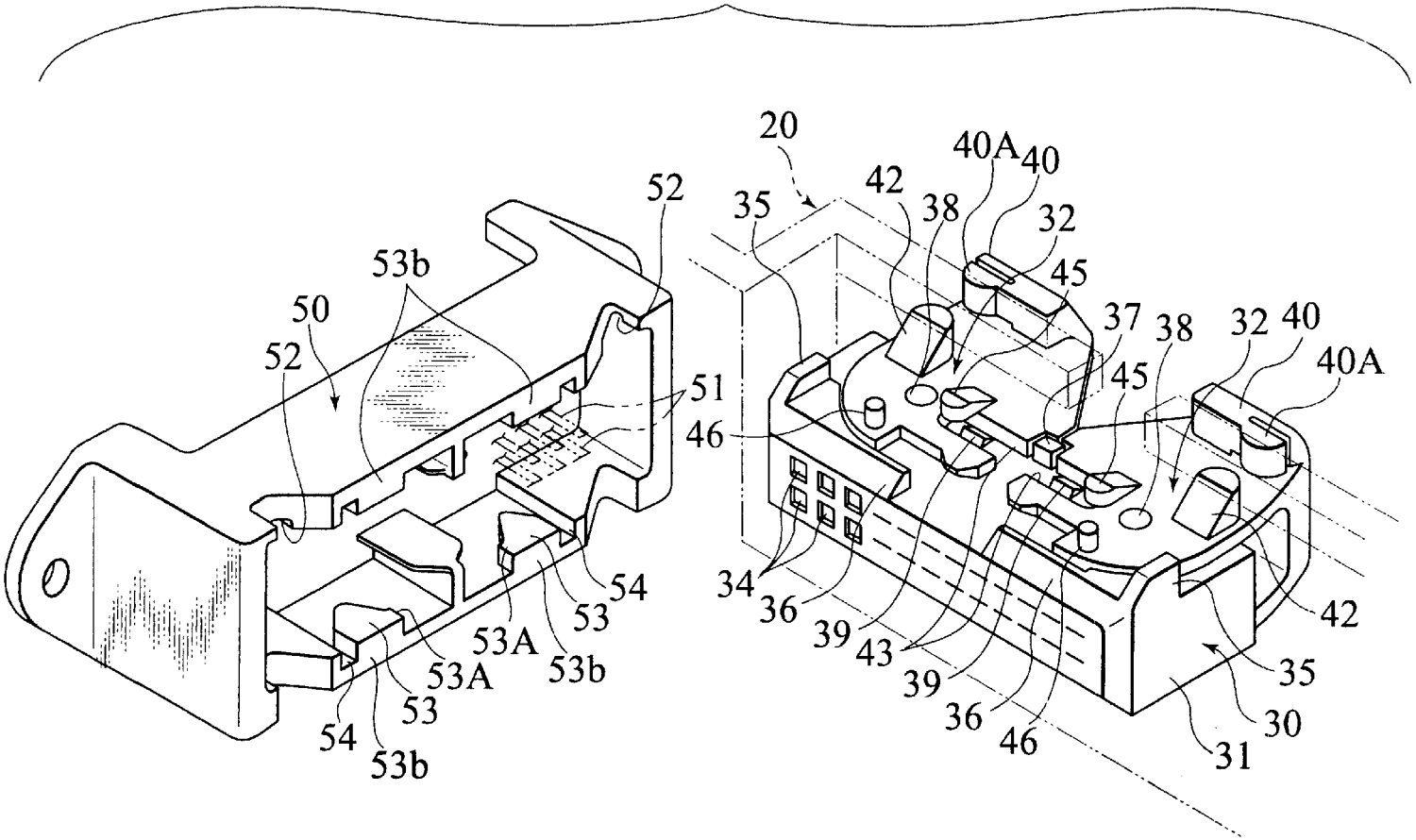
FIG. 1 is a perspective view showing an embodiment of a connector support structure according to the present invention.

Details of a connector support structure according to the present invention will be described below based on an embodiment shown in the drawings.

The connector support structure of the present embodiment is generally formed of a part 20 to be assembled provided on a stay member side of an automobile, for example, a first connector 30 to be assembled in the part 20, and a second connector 50 to be mounted to the first connector 30 as shown in FIG. 1.

Figure 2:
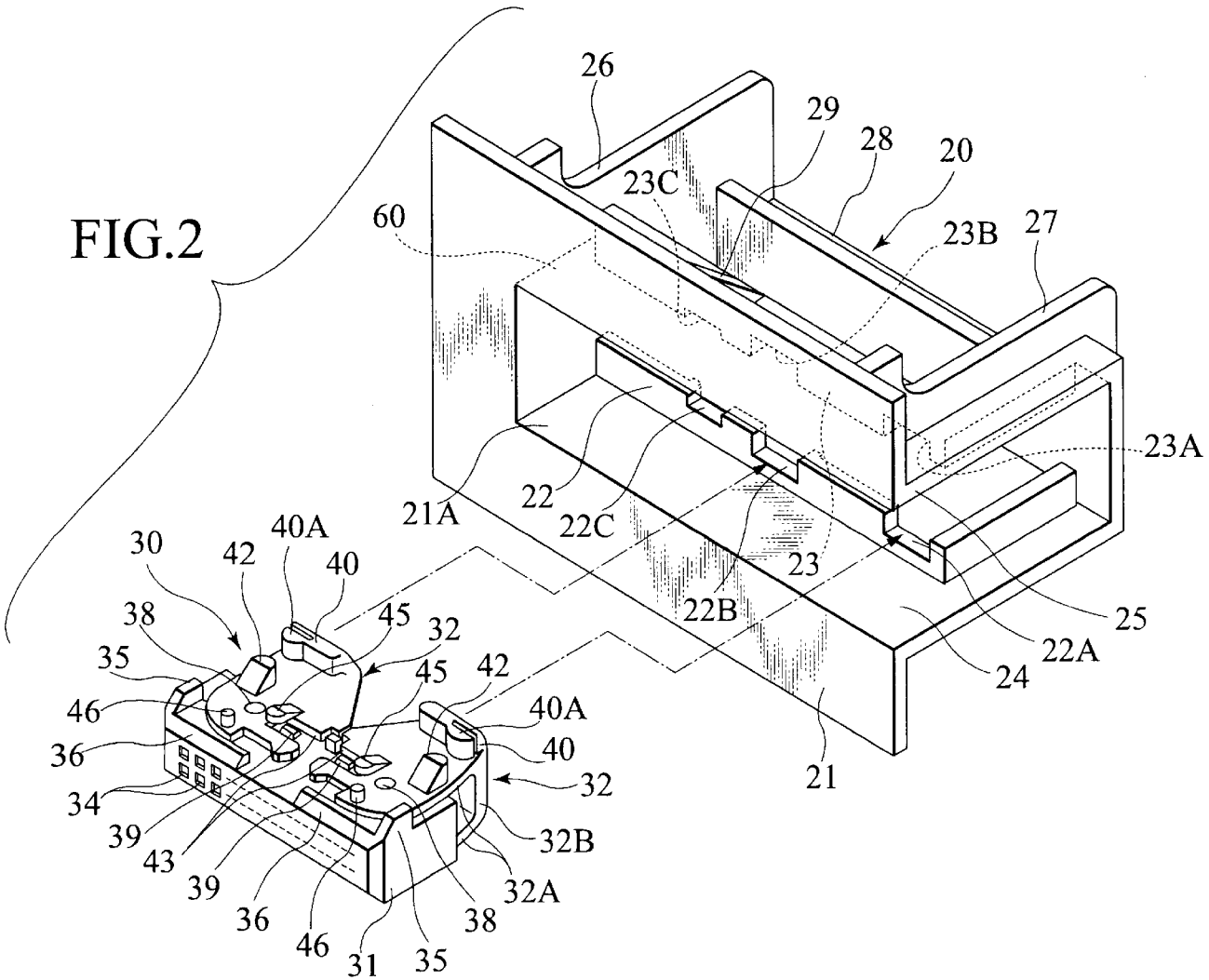
FIG. 2 is a perspective view showing a state in which a first connector is assembled in a part to be assembled in the embodiment.
Figure 3:
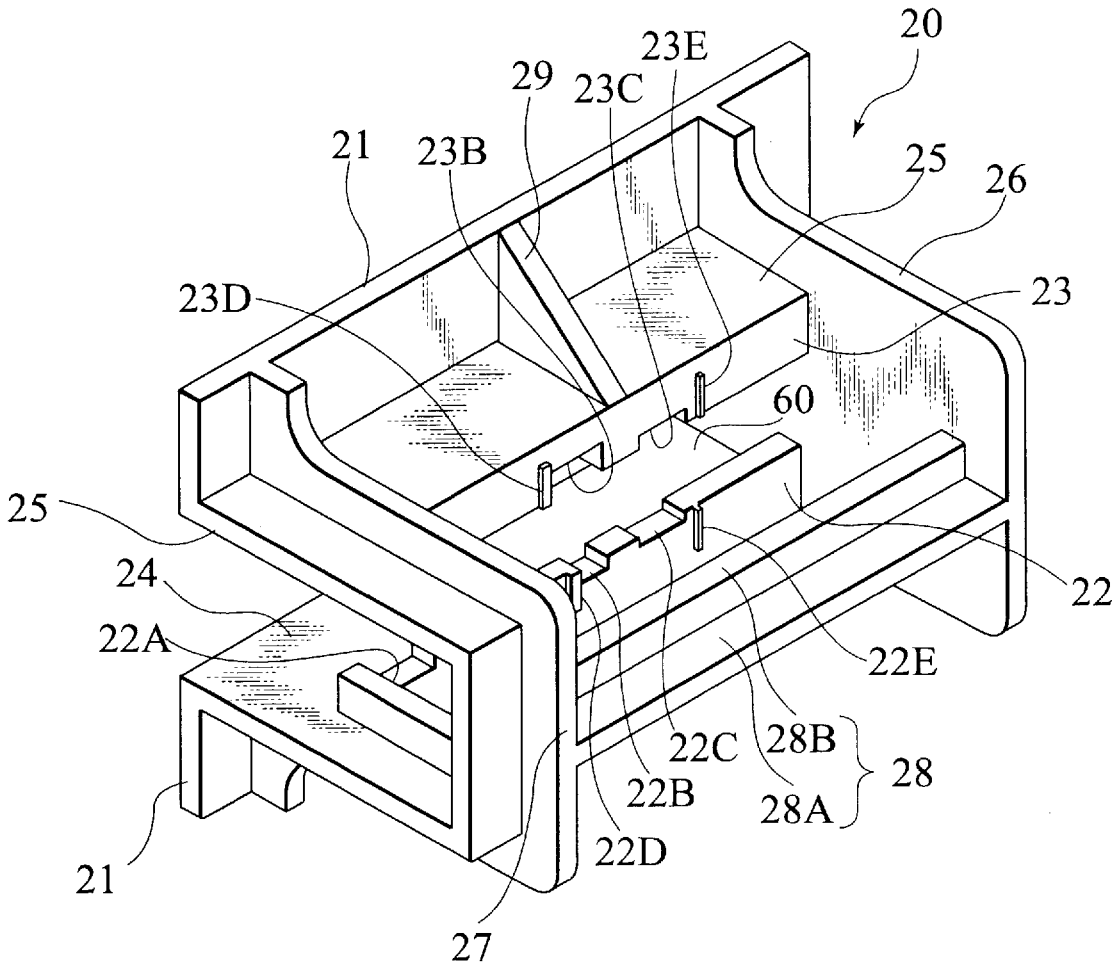
FIG. 3 is a back perspective view of the part in the embodiment.

A structure of the part 20 will be first described by using FIGS. 2 and 3. FIG. 2 is a perspective view in which the part 20 is viewed from a front side and shows a state in which the first connector 30 is inserted into the part 20. FIG. 3 is a perspective view in which the part 20 is viewed from a back side. Although the part 20 prepared separately is fixed to a stay member of the automobile in the present embodiment, the part 20 may be formed integrally with the stay member.

As shown in FIGS. 2 and 3, the part 20 has a rectangular front panel 21 and an upper engagement panel 23 and a lower engagement panel 22 formed and disposed at a predetermined rearward distance from a rectangular opening part 21A formed in the front panel 21, at a vertical distance from each other, and on the identical plane. From another point of view, between the upper engagement panel 23 and the lower engagement panel 22, a slit 60 for sliding the first connector as described later is formed.

In the embodiment, the opening part 21A is formed in a rectangular shape by cutting a side edge of the front panel 21. A transverse dimension of the opening part 21A (a width of an opening in a longitudinal direction) is set to be larger than that of the first connector 30 by a predetermined dimension.

A vertical dimension of the opening part 21A is set to be larger than a height dimension of the second connector 50. A lower reinforcing panel 24 and an upper reinforcing panel 25 are formed to extend rearward and in parallel to each other from lower and upper opening edge parts of the opening part 21A. The lower reinforcing panel 24 is formed integrally with a lower edge part of the lower engagement panel 22. The upper reinforcing panel 25 is formed integrally with an upper edge part of the upper engagement panel 23.

On one side in a transverse direction on a back face of the front panel 21, a rectangular first lateral reinforcing panel 26 is formed integrally with one end edges of the upper engagement panel 23 and the lower engagement panel 22 and one end edges of the lower reinforcing panel 24 and the upper reinforcing panel 25 and extends rearward from the front panel 21. On the other side in a transverse direction on the back face of the front panel 21, a second lateral reinforcing panel 27 having a side face in an angular U shape is formed integrally with the other end edges of the upper engagement panel 23 and the lower engagement panel 22 and the other end edges of the lower reinforcing panel 24 and the upper reinforcing panel 25 and extends rearward from the front panel 21.

As shown in FIG. 3, between rear end parts of the first lateral reinforcing panel 26 and the second lateral reinforcing panel 27, a rear reinforcing member 28 is mounted. The rear reinforcing member 28 is formed of a horizontal panel part 28A and a vertical panel part 28B. The panel parts 28A and 28B are formed integrally with each other so as to form a sectional T shape.

A triangular reinforcing rib 29 is formed integrally with an intermediate part of the back face of the front panel 21 and an intermediate part of an upper face of the upper reinforcing panel 25. Similarly, a triangular reinforcing rib 29 (not shown) is formed integrally with the intermediate part of the back face of the front panel 21 and an inermediate part of a lower face of the lower reinforcing panel 24.

In a vicinity of the other end part of an upper edge part of the lower engagement panel 22, a cut-out 22A for projection insertion having a depth dimension (i.e., a notched amount from the panel upper edge part) slightly larger than a height dimension of a rear engagement projection 40 formed at a rotary member 32 for engagement of the first connector 30 as described later and a transverse dimension slightly larger than that of the rear engagement projection 40 is formed.

A cut-out 22B for projection insertion and having the identical shape as the cut-out 22A is formed at a predetermined distance (toward the one side of the lower engagement panel 22) from the cut-out 22A on the upper edge part of the lower engagement panel 22. Furthermore, in a vicinity (on the one side of the lower engagement panel 22) of the cut-out 22B, a cut-out 22C for projection accommodation having a depth dimension large enough to house a projection 45 for rotation that will be described later and a small transverse dimension is formed.

At a lower edge part of the upper engagement panel 23 and in positions respectively facing the cut-outs 22A and 22B formed on the lower engagement panel 22, cut-outs 23A and 23B for projection insertion having the identical shapes as the cut-outs 22A and 22B are formed. At a lower edge part of the upper engagement panel 23 and in a position facing the cut-out 22C formed at the lower engagement panel 22, a cut-out 23C for projection accommodation having the identical shape as the cut-out 22C is formed.

As shown in FIG. 3, a first protruding bank 22D and a second protruding bank 22E for limiting a provisionally-fastened position of the first connector 30 are respectively formed along a vertical direction on a back face of the lower engagement panel 22. The first protruding bank 22D is formed in a vicinity of the other side edge of the cut-out 22B. The second protruding bank 22E is formed in a vicinity of the one side edge of the cut-out 22C.

As shown in FIG. 3, on a back face of the upper engagement panel 23, a first protruding bank 23D is formed in a position (in a vicinity of the other side edge of the cut-out 23B) corresponding to the first protruding bank 22D formed at the lower engagement panel 22 and a second protruding bank 23E is formed in a position (in a vicinity of the one side edge of the cut-out 23C) corresponding to the second protruding bank 22E. The first protruding banks 22D and 23D of the upper and lower engagement panels 22 and 23 are higher in such a direction as to project rearward from the panels than the second protruding banks 22E and 23E.

Next, a structure of the first connector 30 will be described by using FIGS. 1, 2, 4A to 4C, and 5A to 5C. The first connector 30 is generally formed of a first connector body 31 substantially in a shape of a rectangular parallelepiped and a pair of rotary members 32 for engagement respectively supported on the first connector body 31. The first connector 30 is inserted into and engaged with the part 20 from a rear end face side from which the rotary members 32, 32 project.

Figure 4A:
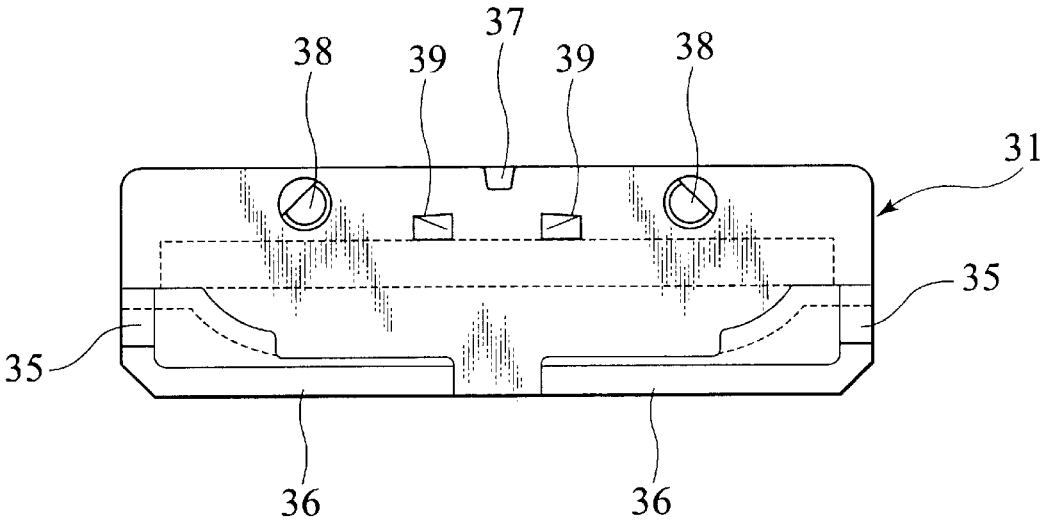
FIG. 4A is a plan view and FIG. 4B is a front view of a first connector body in the embodiment.
Figure 4B:
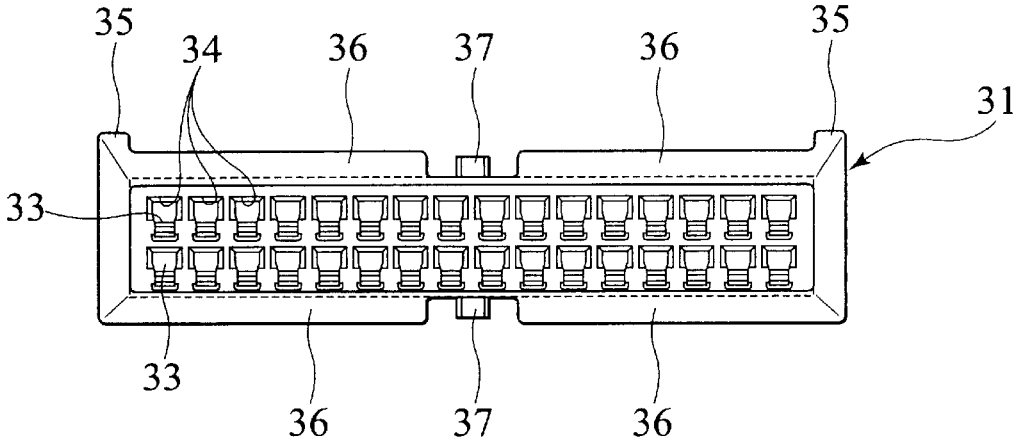

FIGS. 4A and 4B show the first connector body 31 which is not mounted with the rotary members 32. As shown in FIG. 4B, the first connector body 31 has a plurality of terminal accommodation chambers 34 in which female terminal fittings 33 are respectively housed. The female terminal fittings 33 are electrically connected to male terminal fittings 51 on a side of a second connector 50 that will be described later on a front end side of the first connector body 31.

Projections 35 for guide projecting upward are formed on opposite sides of an upper face of a front end of the first connector body 31. Projection banks 36 for guide are formed on left and right at a predetermined distance from each other on each of upper and lower faces of the front end of the first connector body 31. Furthermore, projecting stoppers 37 which limit reverse rotation of the rotary members 32 and with which a front end of the second connector 50 is engaged are respectively formed at central portions of rear edge parts of upper and lower faces of the first connector body 31.

Supporting axes 38 for respectively supporting the rotary members 32 are disposed and provided to project on left and right at a predetermined distance from each other in vicinities of the rear edge part of each of the upper and lower faces of the first connector body 31. Furthermore, projections 39 for provisionally fastening which respectively and provisionally fasten the rotary members 32 supported on the supporting axes 38 are provided to project at a predetermined distance from each other on inner sides of the supporting axes 38 provided to project from each of the upper and lower faces of the first connector body 31.

Figure 5A:
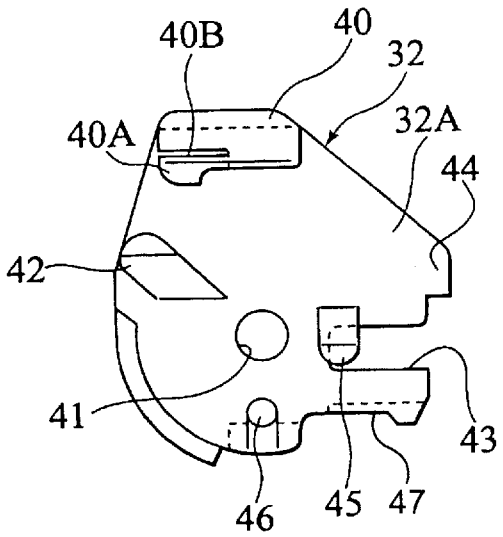
FIG. 5A is a plan view.
Figure 5B:
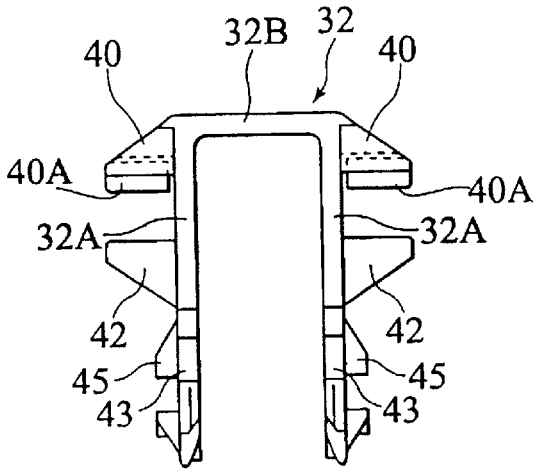
FIG. 5B is a side view.
Figure 5C:
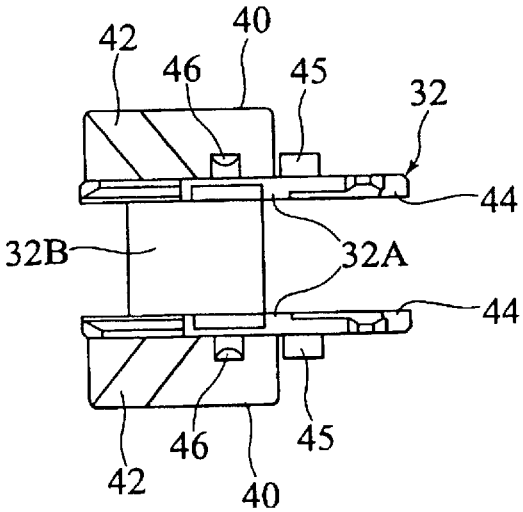
FIG. 5C is a front view of a rotary member for engagement in the embodiment.

Each the rotary member 32 is formed of two parallel plate parts 32A with the identical shapes and a plate part 32B for connection formed integrally with the plate parts 32A so as to connect end parts of the plate parts 32A as shown in FIGS. 5A, 5B, and 5C.

FIG. 5A is a plan view, FIG. 5B is a side view, and FIG. 5C is a front view of the rotary member 32. Each the rotary member 32 can rotate while the plate parts 32A, 32A are supported on the supporting axes 38 formed on the upper and lower faces of the first connector body 31 as shown in FIGS. 1 and 2.

The plate part 32B connects free ends of the rotary member 32 supported on the first connector body 31 through the supporting axes 38. The free end side of the rotary member 32 projects rearward further than the rear end part of the first connector body 31.

Rear engagement projections 40 are formed to project on surfaces of the free end parts of the respective plate parts 32A of the rotary member 32. An engagement part 40A for pressure-contact that can move slightly forward and rearward (pressure-contact direction of the panel) with repulsion in a pressure-contact direction is formed on a front face side (on a side of an axis hole 41 in which the supporting axis 38 fits) of each the rear engagement projection 40 by forming a slit 40B by cutting a side face of the rear engagement projection 40 as shown in FIG. 5A. The engagement part 40A is brought into pressure-contact with a back face of the lower engagement panel 22 or the upper engagement panel 23 when the first connector 30 is assembled in the part 20.

Front engagement projections 42 are provided in an area on one side of a line connecting the axis hole 41 and respective engagement parts 40A of the rotary member 32.

The front engagement projections 42 each have substantially the identical height as the rear engagement projection 40. A rear face 42*a* of the front engagement projection 42 is engaged with the surface of the lower engagement panel 22 or the upper engagement panel 23 when the first connector 30 is assembled in the part 20.

Furthermore, in an area of the plate part 32A on the other side of a line connecting the rear engagement projection 40 and the axis hole 41 and in a position at approximately right angle from the rear engagement projection 40 about the axis hole 41, a cut-out 43 for provisionally fastening is formed by notching a peripheral edge of the plate part 32A toward the axis hole 41 as shown in FIG. 5A.

The projection 39 formed to project from the upper or lower face of the first connector body 31 faces each the cut-out 43 to be engaged with. At a peripheral edge part slightly closer to the free end than the cut-out 43, a stopper engagement part 44 extending slightly away from the axis hole 41 is formed as shown in FIG. 5A.

FIGS. 1 and 2 show a state in which the projections 39 are engaged with the cut-outs 43, i.e., the provisionally fastened state in which the rotary members 32 cannot rotate. In this provisionally fastened state of the rotary members 32, the stopper engagement parts 44 of the respective rotary members 32 are engaged with the stoppers 37 respectively formed on the upper and lower faces of the first connector body 31.

Therefore, the stoppers 37 prevent the respective rotary members 32 from rotating in such directions that the free ends of the pair of rotary members 32 approach each other. The rear engagement projections 40 are set in advance to be disposed in such positions that all the four rear engagement projections 40 can be simultaneously inserted into the cut-outs 22A, 23A, 22B and 23B of the upper and lower engagement panels 22 and 23 of the part 20 when the rotary members 32 are provisionally fastened to the first connector body 31.

Furthermore, a projection 45 for rotation and projecting from each the plate part 32A is provided to an end part of each the cut-out 43 on the axis hole 41 side. The projection 45 functions in such a manner that insertion load of the second connector 50 rotates the rotary member 32 when an end part of the second connector 50 is brought into contact with the projection 45. An engagement protrusion 46 that is guided into the second connector 50 to prevent dropping-off of the second connector 50 is formed to project from an end part of each the plate part 32A positioned on an opposite side to the free end with respect to the axis hole 41.

A structure of the second connector 50 will be described next. As shown in FIG. 1, the second connector 50 is substantially in a shape of a tubular prism and has the plurality of male terminal fittings 51 to be connected to the female terminal fittings 33 disposed in the first connector 30 when the first connector 30 is inserted into the second connector 50. On opposite sides of an inner wall face of an upper part of the second connector 50, grooves 52 for guide and corresponding to the projections 35 formed on the first connector body 31 are formed. Receiving parts 53 for engagement are disposed and formed on left and right of each of the upper and lower inner wall faces, the receiving parts 53 to be engaged with the engagement protrusions 46 on the first connector 30.

On outsides of the receiving parts 42, grooves 54 for engagement and into which the engagement protrusions 46 are introduced are formed. Each the engagement protrusion 46 introduced from the groove 54 moves along a peripheral face of the receiving part 53 and is engaged with an engagement part 53A for protrusion formed at the receiving part 53.

Next, a method of mounting operation, function, and operation of the part 20, the first connector 30, and the second connector 50 of the present embodiment will be described by using FIG. 2 and FIGS. 6 to 12.

Figure 6:
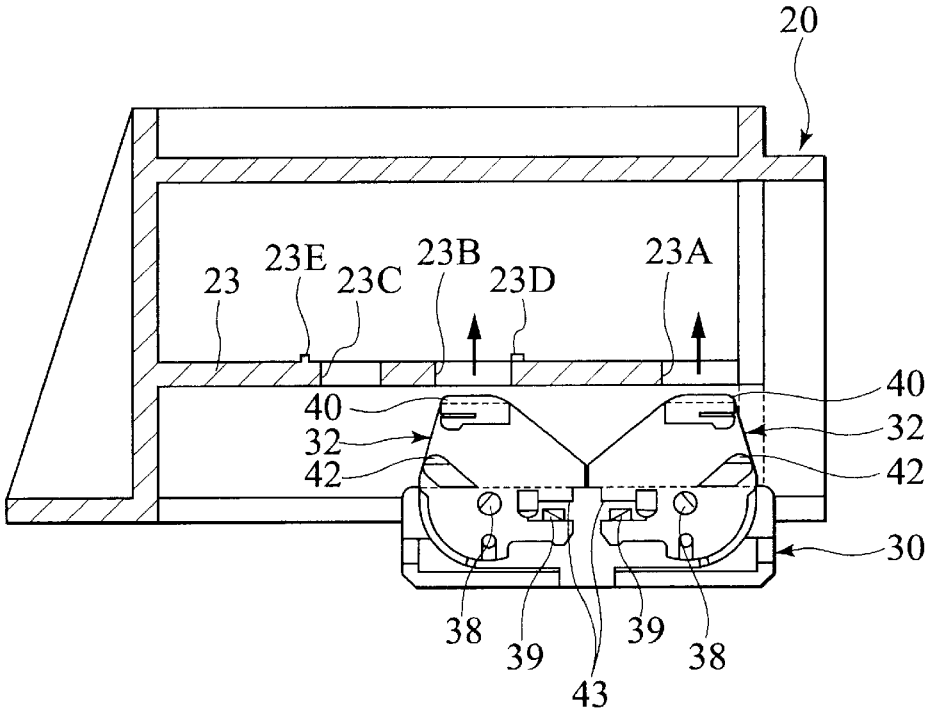
FIG. 6 is a plan partially sectional view showing a state in which the first connector in a provisionally fastened state in the embodiment is assembled in the part.

First, the first connector 30 is inserted into the part 20 in a state in which the rotary members 32, 32 of the first connector 30 are fastened provisionally as shown in FIGS. 2 and 6. The provisionally-fastened state of the rotary members 32 of the first connector 30 is the state in which the projections 39 formed to project from the upper and lower faces of the first connector body 31 face and are engaged in the cut-outs 43 formed at the plate parts 32 of the respective rotary members 32 as described above.

The first connector 30 is inserted into the part 20 by causing the first connector 30 with the provisionally-fastened rotary members 32, 32 to approach the part 20 such that the all four rear engagement projections 40 formed at the free ends of the pair of rotary members 32 correspond to the respective cut-outs 22A, 22B, 23A, and 23B formed at the lower engagement panel 22 and the upper engagement panel 23.

As described above, since the four rear engagement projections 40 cannot pass through the cut-outs 22A, 22B, 23A and 23B formed at the lower engagement panel 22 and the upper engagement panel 23 (the rear engagement projections 40 is brought into contact with the lower engagement panel 22 and the upper engagement panel 23) if the rotary members 32 are not in the provisionally-fastened state (e.g., provisionally fastening is released), it is possible to prevent the first connector 30 from being assembled in an improper position of the part 20. In a state in which the rear engagement projections 40 are inserted to the back face sides of the upper and lower engagement panels 22 and 23, the front engagement projections 42 formed on the rotary members 32 of the first connector 30 are engaged with the front face sides of the upper and lower engagement panels 22 and 23.

Figure 7:
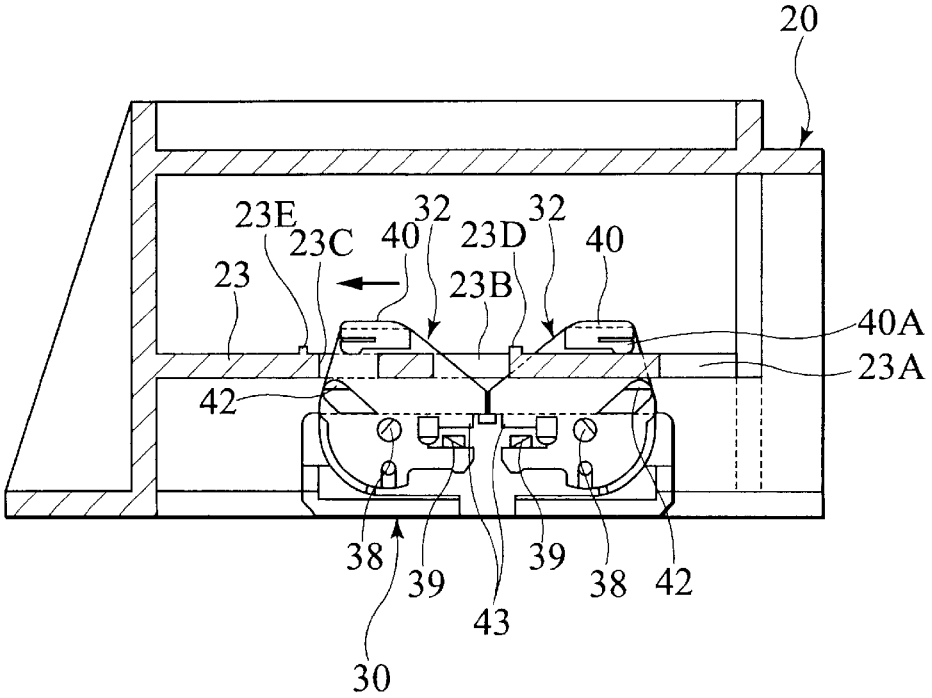
FIG. 7 is a plan partially sectional view showing a state in which the first connector in the provisionally fastened state in the embodiment is assembled in the part and slid.

Next, the all four rear engagement projections 40 formed at the free ends of the pair of rotary members 32 pass through the respective cut-outs 22A, 22B, 23A, and 23B formed at the lower engagement panel 22 and the upper engagement panel 23. The four rear engagement projections 40 reach the back face sides of the lower engagement panel 22 and the upper engagement panel 23. The first connector 23 is slid to the one side (left side in the embodiment) of the part 20 as shown in FIG. 7.

In the above sliding operation, since the rotary members 32 are provisionally fastened to the first connector body 31 when the projections 39 are engaged with the cut-outs 43, rotations of the rotary members 32, 32 is limited. Since the rotary members 32 do not rotate with respect to the first connector body 31 in the sliding, it is possible to reduce tendency of the rear engagement projections 40 and the front engagement projections 42 to loose against or to be caught by the front and back faces of the upper and lower engagement panels 22 and 23.

Such a sliding operation is carried out by holding and sliding the first connector 30 sideways by using a hand. As described below, the first connector 30 can be slid to predetermined positions of the upper and lower engagement panels 22 and 23. As shown in FIG. 7, the rear engagement projections 40 that have passed through the cut-outs 22A, 22B, 23A, and 23B and reached the back face sides of the upper and lower engagement panels 22 and 23 slide and move on the back faces of the upper and lower engagement panels 22 and 23 in the sliding operation.

Figure 8:
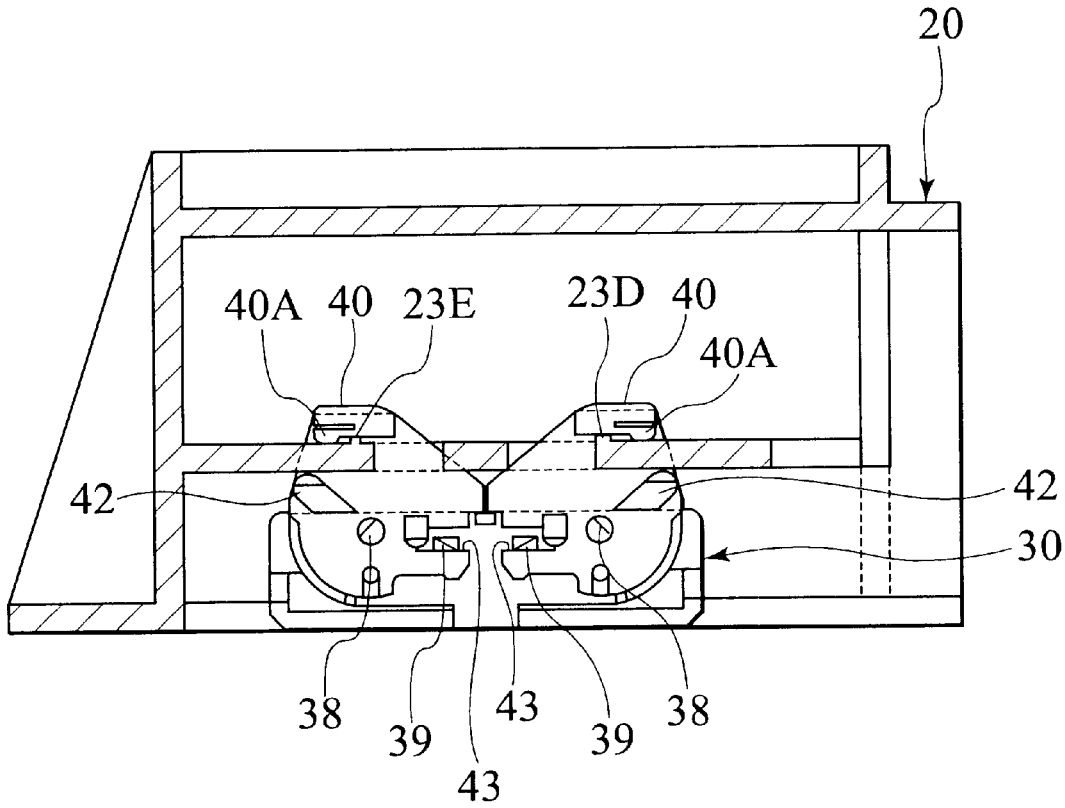
FIG. 8 is a plan partially sectional view showing a state in which the first connector in the embodiment has been moved to a proper position of the part.
Figure 9:
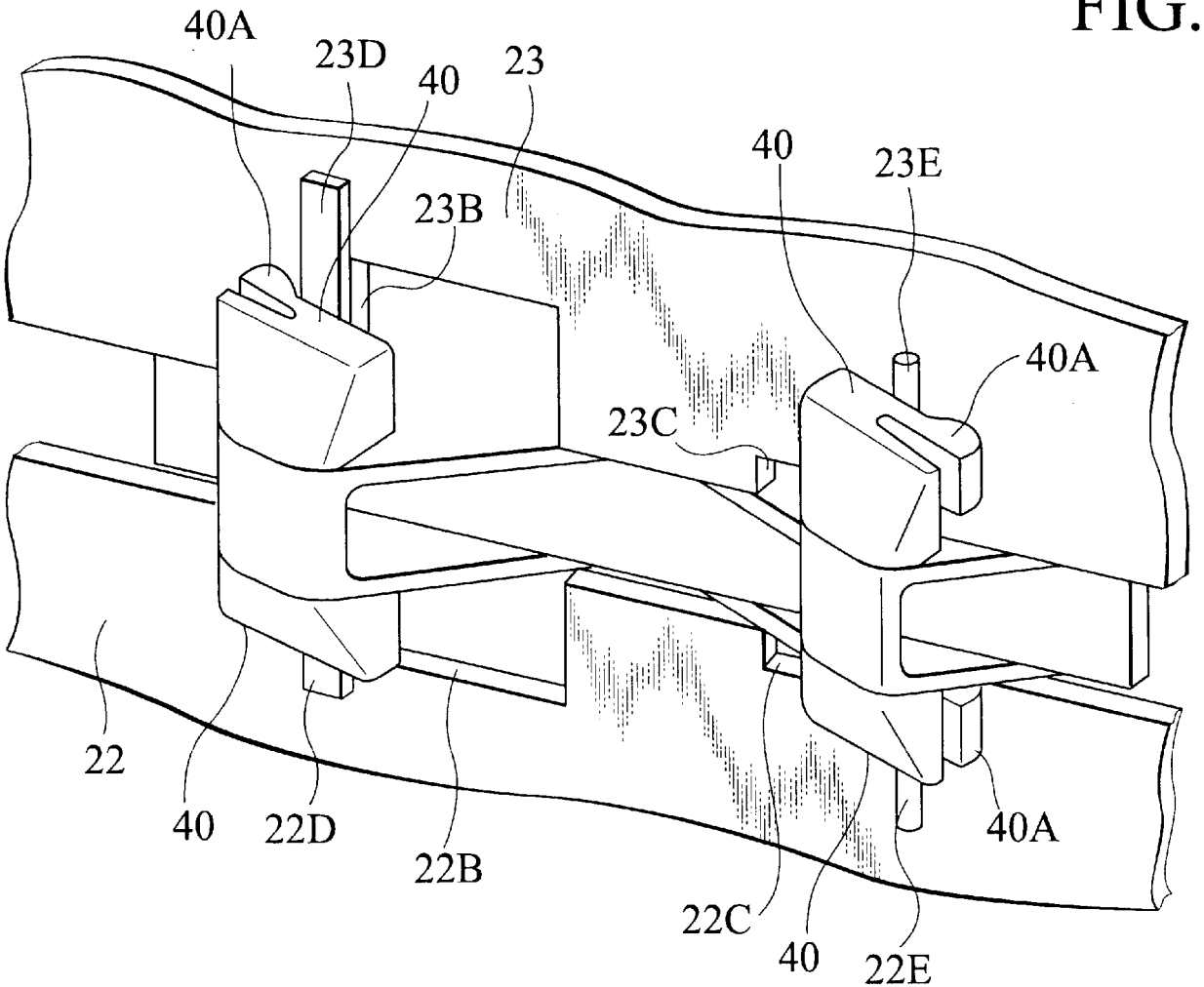
FIG. 9 is a perspective view of the state in which the first connector in the embodiment has been moved to the proper position of the part viewed from a back side of the part.

Then, as shown in FIG. 8, the rear engagement projections 40, 40 that have passed through the cut-outs 22B and 23B pass over the second protruding banks 22E and 23E formed in vicinities of the one side edges of the cut-outs 22C and 23C. FIG. 9 shows a state in which the rear engagement projections 40 are in predetermined positions (provisionally-fastened position relative to the part 20) viewed from back sides of the upper and lower engagement panels 22 and 23.

The first protruding banks 23D and 22D of the upper and lower engagement panels 22 and 23 project further rearward from the panels than the second protruding banks 23E and 22E. Therefore, the rear engagement projections 40 which have passed through the cut-outs 22A and 23A cannot pass over the first protruding banks 22D and 23D, so that the first protruding banks 22D and 23D function as positioning members.

Figure 10:
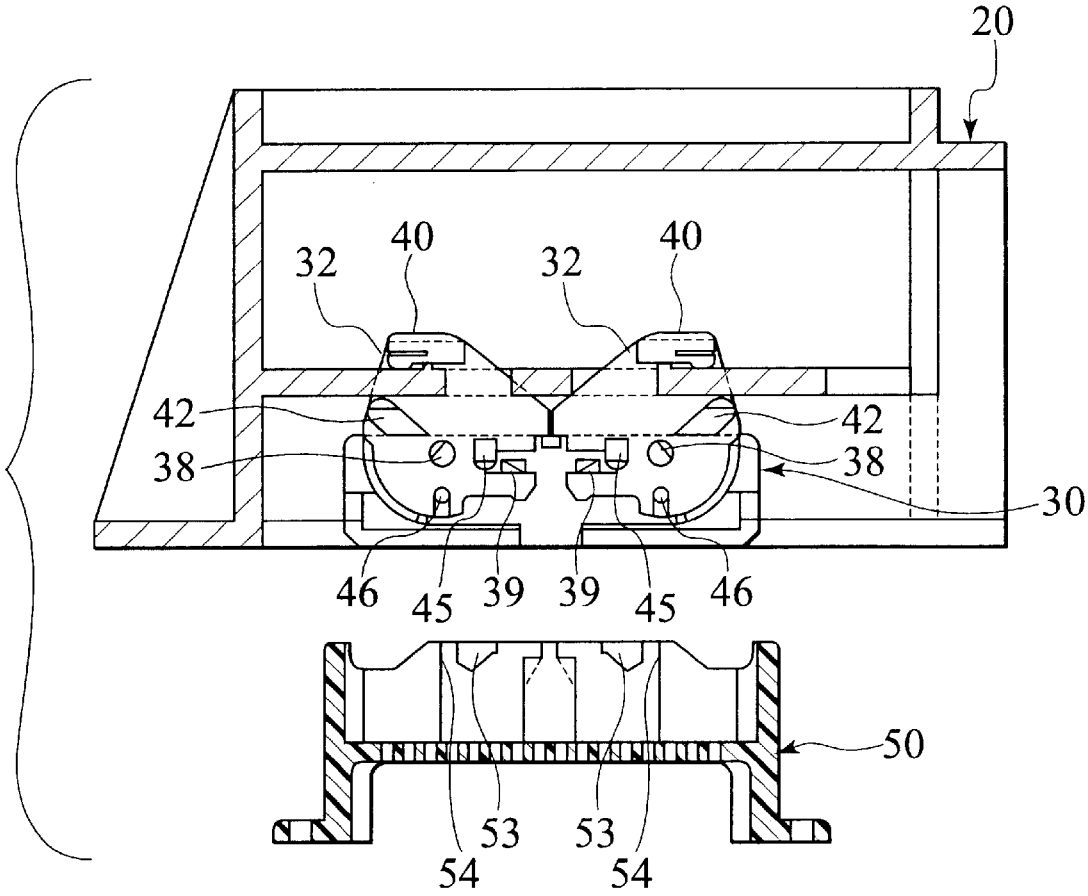
FIG. 10 is a plan partially sectional view showing a state in which a second connector is mounted to the first connector that is provisionally fastened to the part.

Next, as shown in FIGS. 1 and 10, the second connector 50 is caused to approach the first connector 30. The second connector 50 is fitted in the first connector 30 such that the projections 35 formed on opposite sides of the upper face of the front end of the first connector body 31 are fitted in the grooves 52 formed on the opposite sides of the upper inner wall face of the second connector 50. At this time, engagement protrusions 46 formed at the font end parts of the rotary members 32 enter the grooves 54 formed on the upper and lower inner wall faces of the second connector 50.

Figure 11:
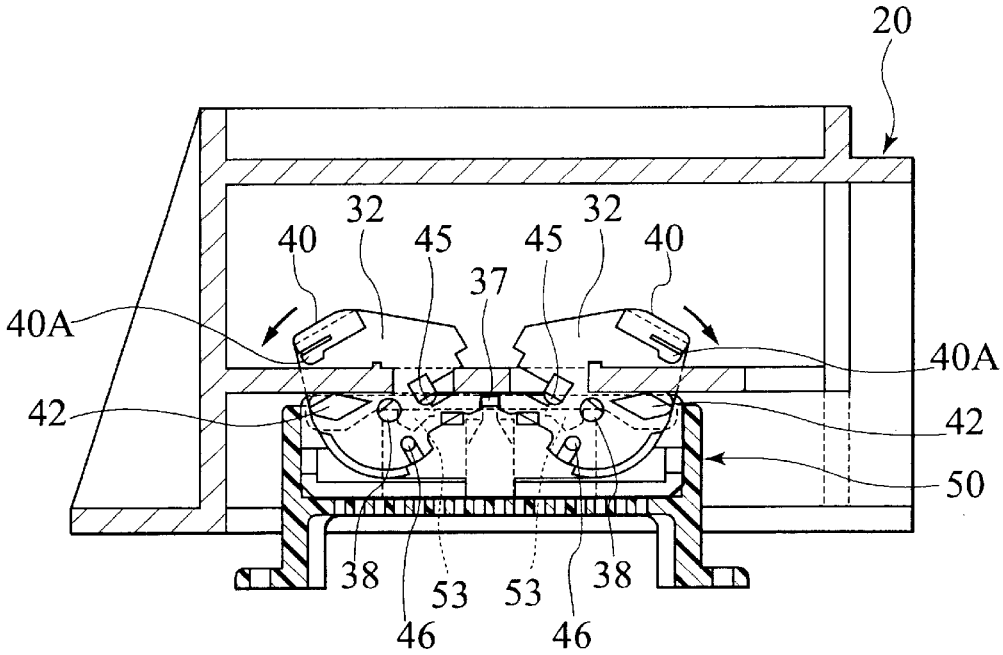
FIG. 11 is a plan partially sectional view showing an intermediate state in which the second connector is mounted to the first connector in the embodiment.

Then, if the second connector 50 is pushed in such that the second 50 is fitted into the first connector 30 by force that can release the above provisionally-fastened state as shown in FIG. 11, end faces 53*b* of the receiving parts 53 of the second connector 50 push the projections 45 of the rotary members 32 rearward. Therefore, the rotary members 32, 32 of the pair are rotated in such directions that the rear engagement projections 40 of the rotary members 32, 32 move away from each other.

As a result, the projections 39 are detached from the cut-outs 43 formed at the plate parts 32A. Thus, the provisionally fastened state of the rotary members 32 with respect to the first connector body 31 are released. Then, if the rear engagement projections 40 move away from each other and the lower engagement panel 22 and the upper engagement panel 23 are held between the front engagement projections 42 and the rear engagement projections 40 as shown in FIG. 11, the first connector 30 is fixed to the part 20.

Figure 12:
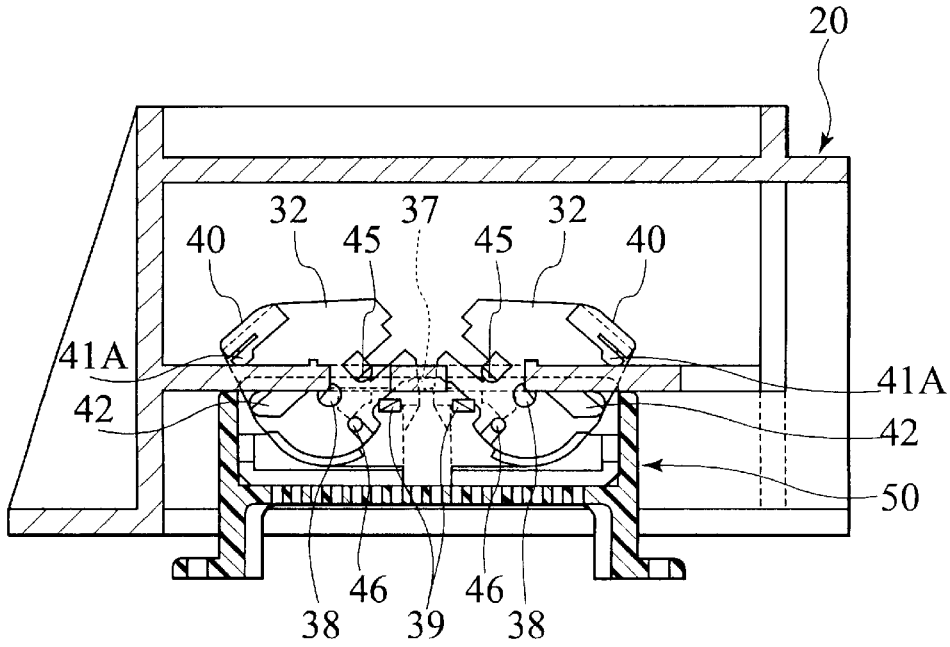
FIG. 12 is a plan partially sectional view showing a state in which the second connector is completely mounted to the first connector in the embodiment.

Then, by pushing the second connector 50 until the end faces of the second connector 50 are engaged with the stoppers 37 formed on the first connector body 31 as shown in FIG. 12, the second connector 50 is completely connected to the first connector 30. At this time, the engagement protrusion 46 formed at the front end of each the rotary member 32 of the first connector 30 rotates to move around the back side of the receiving part 53 and is positioned at the rear of the engagement part 53A shown in FIG. 1 to perform function of preventing dropping off of the second connector 50. With the above operations, assembly of the first connector 30 and the second connector 50 connected to each other in the part 20 is completed.

When the rotary members 32 are rotated, the engagement parts 40A of the rear engagement projections 40 are brought into contact with the back faces of the lower engagement panel 22 and the upper engagement panel 23 with repulsion in the embodiment. As a result, the panels can be firmly held between the rear engagement projections 40 and the front engagement projections 42 and generation of loosing of the first connector 30 can be prevented.

Although the embodiment has been described above, the invention is not limited to the embodiment and various modifications in design according to the summary of the structure may be made. For example, although the pair of rotary members 32 is provided to the first connector 30 in the above embodiment, one, three, or more rotary members 32 may be provided.

What is claimed is:

1. A connector support structure comprising:

a first connector having a rear end side supported by a part to be assembled; and a second connector to be fitted with the first connector and mounted from a front end side thereof, the first connector and the second connector being electrically connected to each other, wherein the first connector comprises:

a first connector body having projections; and a plurality of rotary members, each rotary member being supported by a supporting axis onto the first connector body and having free end parts projecting from a rear end face of the first connector body, wherein the rotary members comprise:

rear engagement projections provided at the free end parts, the rear engagement projections projecting in substantially a right angle relative to rotation faces of the rotary members, front engagement projections provided at positions closer to the supporting axis than to the rear engagement projections; and cut-out parts for provisionally fastening engagement with the projections of the first connector body, wherein the part to be assembled comprises an engagement panel including cut-out parts for receiving the rear engagement projections from a front side to a back side of the engagement panel while the projections of the first connector body are in provisionally fastening engagement with the cut-out parts of the rotary members.

2. The connector support structure according to claim 1, wherein the part includes a slit part to allow the rotary members to slide when the rear engagement projections are on the back side of the engagement panel.

3. The connector support structure according to claim 1, wherein the part comprises:

a pair of reinforcing panels, the reinforcing panels being parallel to and spaced from each other at a distance, the reinforcing panels defining an opening part to accommodate at least a portion of the first connector therein.

4. The connector support structure according to claim 1, wherein the rotary members have periphery parts, and wherein the projections of the first connector body are to be engaged with the periphery parts of the rotary members to restrict the rotary members in directions of disengagement thereof when the rear engagement projections and the front engagement projections hold the engagement panel therebetween for the first connector to be mounted to the part.

5. The connector support structure according to claim 1, wherein the rotary members have projections for rotation to engage with the second connector for transmitting rotation force to the rotary members when fitting the second connector with the first connector.

* * * * *